US006688275B2

(12) United States Patent
Shindou et al.

(10) Patent No.: US 6,688,275 B2
(45) Date of Patent: Feb. 10, 2004

(54) HYDRAULIC PRESSURE CONTROL SYSTEM FOR CYLINDER CUTOFF DEVICE OF INTERNAL COMBUSTION ENGINE

(75) Inventors: Shigeki Shindou, Yokohama (JP); Shigeru Sakuragi, Tokyo (JP); Masaki Toriumi, Yokohama (JP); Kazuto Tomogane, Yokohama (JP)

(73) Assignee: Nissan Motor Co., Ltd., Yokohama (JP)

( * ) Notice: Subject to any disclaimer, the term of this patent is extended or adjusted under 35 U.S.C. 154(b) by 0 days.

(21) Appl. No.: 10/058,049

(22) Filed: Jan. 29, 2002

(65) Prior Publication Data

US 2002/0100451 A1 Aug. 1, 2002

(30) Foreign Application Priority Data

Jan. 30, 2001 (JP) ..... 2001-021308

(51) Int. Cl.[7] ..... F02B 77/00
(52) U.S. Cl. ..... 123/198 F; 123/481
(58) Field of Search ..... 123/90.15, 90.16, 123/90.17, 90.18, 198 F, 481, 198 R, 198 DB

(56) References Cited

U.S. PATENT DOCUMENTS 5,425,335 A * 6/1995 Miyamoto et al. ..... 123/198 F
5,481,461 A * 1/1996 Miyamoto et al. ..... 701/99
5,492,100 A * 2/1996 Ishii et al. ..... 123/481
5,636,609 A * 6/1997 Fujiyoshi ..... 123/198 F
6,138,636 A * 10/2000 Kohno et al. ..... 123/198 F

FOREIGN PATENT DOCUMENTS

JP 5-248217 9/1993

* cited by examiner

*Primary Examiner*—Henry C. Yuen
*Assistant Examiner*—Hyder Ali
(74) *Attorney, Agent, or Firm*—Foely & Lardner

(57) ABSTRACT

In a hydraulic pressure control system for an engine cylinder cutoff device through which a first group of cylinders are cut off with at least intake valves of engine valves included in the first group kept inactive, while a second group of cylinders are working, the system includes a valve mode switching mechanism being responsive to supply oil pressure for switching an operating mode of at least an intake valve of engine valves of each of the first group of engine cylinders from active to inactive. Also provided is a hydraulic pressure control valve regulating the supply oil pressure. A control unit incorporated in the system sets the supply oil pressure to a predetermined maximum pressure when initiating the inactive mode, and holds the supply oil pressure at a predetermined oil pressure lower than the predetermined maximum pressure before the inactive mode is released.

16 Claims, 10 Drawing Sheets

INJECTION TIMING
VALVE LIFT (INTAKE VALVE)
INACTIVE MODE
HYDRAULIC CONTROL VALVE VOLTAGE
MAXIMUM VOLTAGE V1
PREDETERMINED VOLTAGE V2
SUPPLY OIL PRESSURE
P2
SWITCHING REQUIREMENT OIL PRESSURE P4
TIME
t1'
t2'
t3'
SWITCHING SIGNAL ON (T1)
RECOVERY SIGNAL ON (T2)
t1'>t1
t2'<t2

HYDRAULIC PRESSURE CONTROL SYSTEM FOR CYLINDER CUTOFF DEVICE OF INTERNAL COMBUSTION ENGINE

TECHNICAL FIELD

The present invention relates to a hydraulic pressure control system for a cylinder cutoff device of an internal combustion engine, and particularly to techniques for electronically controlling hydraulic pressure supplied to a hydraulically-operated active/inactive valve mode switching mechanism of an engine cylinder cutoff device through which a first group of engine cylinders are cut off with at least intake valves of their engine valves, kept inactive, while a second group of engine cylinders are working.

BACKGROUND ART

In recent years, there have been proposed and developed various automotive engine cylinder cutoff devices in which several cylinders are cut off during idling or during low load conditions, for improved fuel economy and improved thermal efficiency. In such engine cylinder cutoff devices, at least intake valves of several cylinders are temporarily shifted to their inactive states and stopped. One such engine cylinder cutoff device has been disclosed in Japanese Patent Provisional Publication No. 5-248217 (hereinafter is referred to as "JP5-248217"). In the cylinder cutoff device (or cylinder stop device or engine-valve stop device) disclosed in JP5-248217, switching between active and inactive modes of each of at least intake valves, which are subjected to cylinder cutoff control, is achieved by regulating supply oil pressure fed into an oil pressure chamber defined in the associated rocker arm by means of a hydraulic pressure control valve. In order to enhance the response to a pressure rise in supply oil pressure at the early stage of shifting to the inactive valve mode, the cylinder cutoff device of JP5-248217 uses an assist oil pump connected to the hydraulic pressure control valve. The assist oil pump is driven by way of an assist oil pump cam. The number of cam portions of the assist oil pump cam is set to be greater than or equal to the number of inactive cylinders, and therefore the assist oil pump can be kept in its discharge state at any time when switching from active to inactive and pressurized oil pressure is higher than a switching requirement oil pressure needed to switching action from active to inactive can be reliably supplied, thus minimizing the response time delay in switching to the inactive mode.

SUMMARY OF THE INVENTION

In the previously-discussed cylinder cutoff device as disclosed in JP5-248217, there are two important factors affecting the engine performance, namely, one being the response to a pressure rise in supply oil pressure at the early stage of shifting to the inactive valve mode, and the other being the response to a pressure drop in supply oil pressure in the recovery period to the active valve mode. In more detail, as a matter of course, fuel injection for inactive cylinders has to be inhibited in synchronization with the mode shifting from active to inactive. Conversely when returning to the active valve mode, that is, when the inactive valve mode is released and thus cylinder cutoff control function is disengaged, fuel injection has to be restarted in synchronization with the mode shifting from inactive to active. Assuming that the response to the supply-oil-pressure drop in the recovery period is low, there is a possibility that fuel injection initiates before the engine valve subjected to cylinder cutoff control is actually activated and opened. This deteriorates exhaust emission control performance and fuel economy. When the assist oil pump is used to realize increased supply pressure and enhanced response to the supply-oil-pressure rise at the early stage of shifting to the inactive mode, the entire system construction of the valve operating system tends to be very complicated. Owing to the use of the assist oil pump, there is an increased tendency for the supply oil pressure to be kept at a relatively high level even during inactive valve mode. As a result of this, during the recovery period from inactive to active, the response time delay in recovery to the active mode, that is, the recovery time in switching from inactive to active tends to be increased or lengthened. This deteriorates or lowers the control responsiveness during the recovery period.

Accordingly, it is an object of the invention to provide a hydraulic pressure control system for a cylinder cutoff device of an internal combustion engine, which avoids the aforementioned disadvantages.

It is another object of the invention to provide a hydraulic pressure control system for an active/inactive valve mode switching mechanism of an automotive engine cylinder cutoff device, which is simple in construction and is capable of effectively enhancing the control responsiveness during shifting to an active valve mode as well as during shifting to an inactive valve mode (or to a cylinder cutoff mode) without using an assist oil pump.

The other objects and features of this invention will become understood from the following description with reference to the accompanying drawings.

DESCRIPTION OF THE PREFERRED EMBODIMENTS

Figure 1:
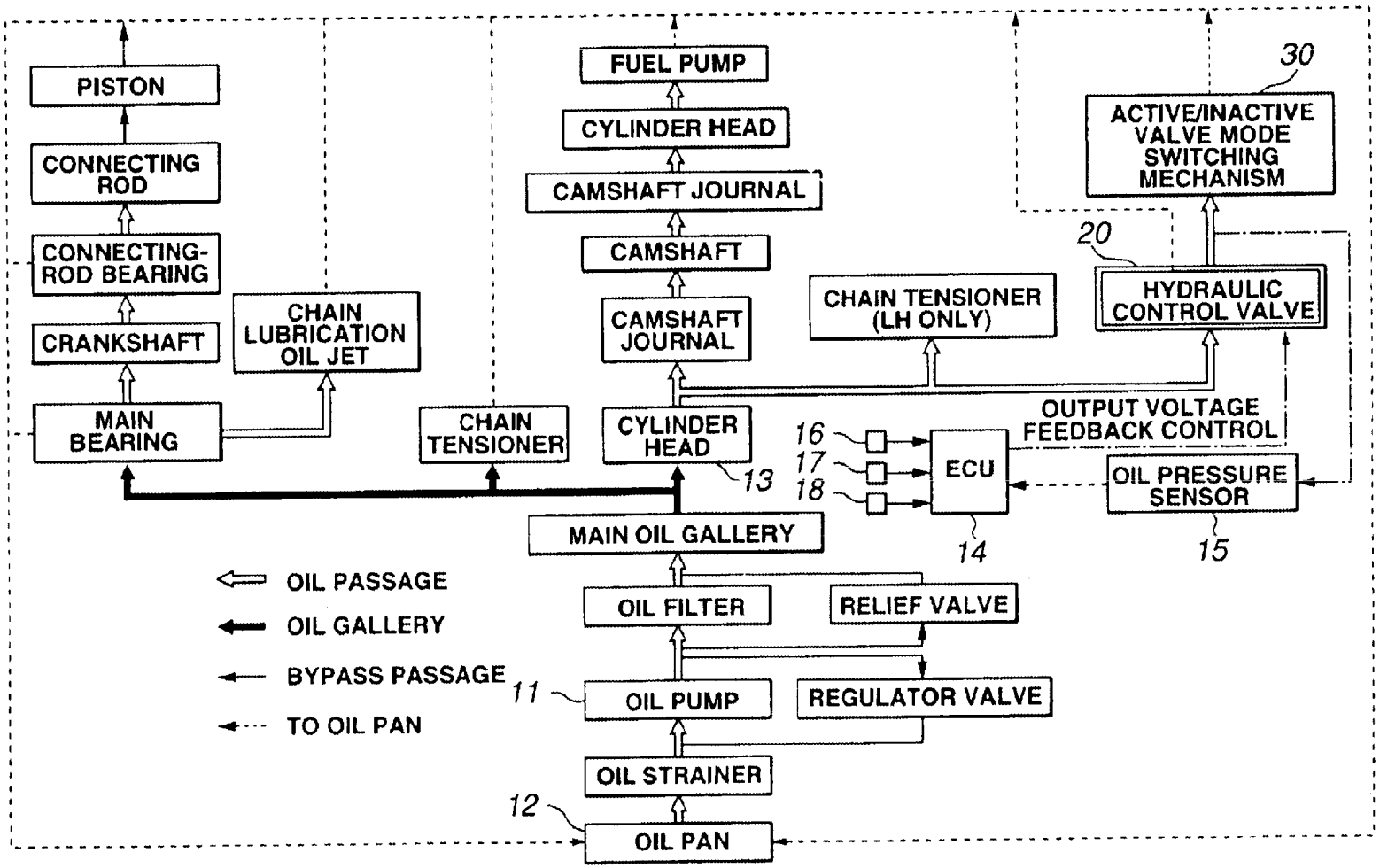
FIG. 1 is a hydraulic circuit diagram illustrating one embodiment of a hydraulic pressure control system of an active/inactive valve mode switching mechanism of an engine cylinder cutoff device.
Figure 2:
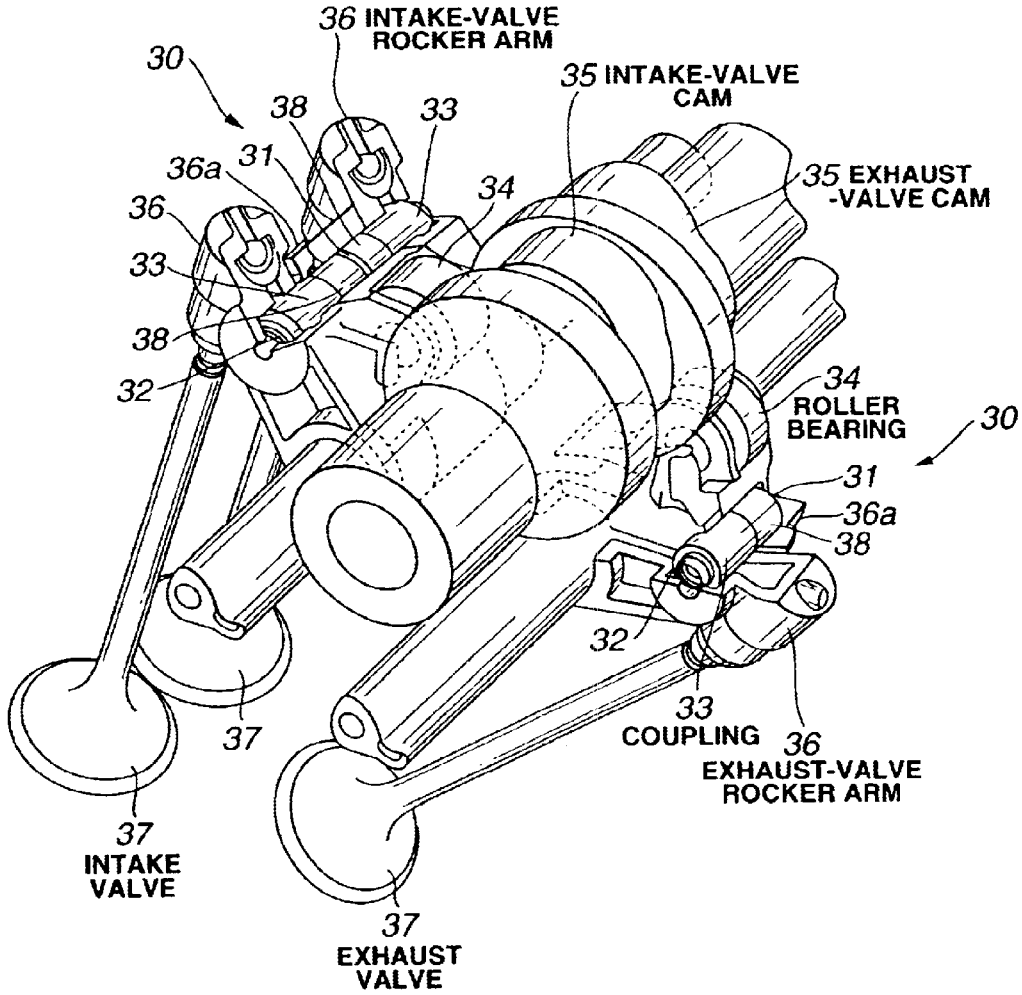
FIG. 2 is a perspective view illustrating the active/inactive valve mode switching mechanism incorporated in the system of the embodiment.

Referring now to the drawings, particularly to FIGS. 1–2, there is shown the fundamental construction of the hydraulic pressure control system for the active/inactive valve mode switching mechanism 30 of a cylinder cutoff device of an internal combustion engine. As appreciated from the hydraulic circuit shown in FIG. 1, in the same manner as a conventional engine lubricating system, in the system of the embodiment, oil (working fluid or lubricating oil) is delivered from an oil pan 12 through an oil strainer and an oil pump 11 serving as a hydraulic pressure source via an oil filter to a main oil gallery. For the purpose of lubrication and heat removal, oil fed into the main gallery flows through oil passages in a cylinder block and cylinder head 13 into many engine component parts and bearings, such as a main bearing, a crankshaft, a connecting-rod bearing, a connecting rod, a piston, a timing chain oil jet, a chain tensioner, a camshaft journal, a camshaft, a fuel injection pump, a left-hand side camshaft chain tensioner, an engine cylinder wall, and the like. After lubricating and heat removing action, the oil is returned to oil pan 12. As can be appreciated from the right-hand side of FIG. 1, part of the oil is supplied via the hydraulic pressure control valve 20 to active/inactive valve mode switching mechanism 30.

An electronic engine control unit (ECU) 14 generally comprises a microcomputer. The control unit includes an input/output interface (I/O), memories (RAM, ROM), and a microprocessor or a central processing unit (CPU). The input/output interface (I/O) of ECU 14 receives input information from various engine/vehicle sensors, namely an engine speed sensor 16, an engine temperature sensor 17, an oil degradation sensor 18, and the like. As necessary, an oil pressure sensor 15 is also used to detect or measure supply oil pressure P fed from hydraulic pressure control valve 20 to active/inactive valve mode switching mechanism 30. Engine speed sensor 16 is provided to detect engine speed. Engine temperature sensor 17 is provided to detect engine temperature such as engine oil temperature or engine coolant temperature. Oil degradation sensor 18 is provided to detect the degree of degradation or deterioration of engine oil (working fluid or engine lubricating oil). Within ECU 14, the central processing unit (CPU) allows the access by the I/O interface of input informational data signals from the previously-discussed engine/vehicle sensors 15, 16, 17, and 18. The CPU of ECU 14 is responsible for carrying the engine control (including fuel injection control)/hydraulic-pressure control valve solenoid output voltage feedback control program stored in memories and is capable of performing necessary arithmetic and logic operations shown in FIG. 4 or 6. Computational results (arithmetic calculation results), that is, calculated output signals (solenoid drive currents or solenoid drive voltages) are relayed via the output interface circuitry of ECU 14 to output stages, namely a fuel injector solenoid included in an electronic fuel-injection system and an electromagnetic solenoid for hydraulic pressure control valve 20.

Referring now to FIG. 2, there is shown the detailed construction of active/inactive valve mode switching mechanism 30 of the engine cylinder cutoff device. In the shown embodiment, active/inactive valve mode switching mechanism 30 is exemplified in a three-valve internal combustion engine. A first active/inactive valve mode switching mechanism 30 is associated with two intake valves of three engine valves (37, 37, 37) per cylinder. A second active/inactive valve mode switching mechanism 30 is associated with one exhaust valve of three engine valves (37, 37, 37). Each of the first and second active/inactive valve mode switching mechanisms (30, 30) is operated or activated by way of the supply oil pressure supplied to a hydraulic pressure chamber 31. With first active/inactive valve mode switching mechanism 30 activated, the two intake valves (37, 37) of the engine cylinder subjected to cylinder cutoff control are controlled to their inactive states. Likewise, with second active/inactive valve mode switching mechanism 30 activated, the one exhaust valve (37) of the same engine cylinder subjected to cylinder cutoff control is controlled to its inactive state. When hydraulic pressure in hydraulic pressure chamber 31 included in the first active/inactive valve mode switching mechanism 30 is low and less than a predetermined pressure level, by means of a return spring 32 couplings 33 are kept in their spring-loaded positions in which couplings 33 are in sliding-contact with an auxiliary rocker arm 36*a* having a roller bearing 34. Rotary motion of a cam 35 of the intake valve side is transmitted through an auxiliary rocker arm 36*a*, couplings 33, and rocker arms 36 to the intake valves. In a similar manner, when hydraulic pressure in hydraulic pressure chamber 31 included in the second active/inactive valve mode switching mechanism 30 is low and less than a predetermined pressure level, by means of a return spring 32 a coupling 33 is kept in its spring-loaded position in which coupling 33 is in sliding-contact with an auxiliary rocker arm 36*a* having a roller bearing 34. Rotary motion of a cam 35 of the exhaust valve side is transmitted through an auxiliary rocker arm 36*a*, coupling 33, and a rocker arm 36 to the exhaust valve. In this manner, in case of a low supply oil pressure, a so-called all-cylinder working mode (simply, an active valve mode or an active mode) is achieved. In contrast to the above, when the supply oil pressure in hydraulic pressure chamber 31 included in the first active/inactive valve mode switching mechanism 30 related to the intake valves of the engine cylinder subjected to cylinder cutoff control becomes high and exceeds the predetermined pressure level, piston plungers (38, 38) force the respective couplings (33, 33) to axially move away from auxiliary rocker arm 36*a* against the spring bias of return spring 32. As a result, power transmission through auxiliary rocker arm 36*a* to two couplings (33, 33) of the intake valve side is shut off. Similarly, when the supply oil pressure in hydraulic pressure chamber 31 included in the second active/inactive valve mode switching mechanism 30 related to the exhaust valve of the engine cylinder subjected to cylinder cutoff control becomes high and exceeds the predetermined pressure level, a piston plunger 38 forces coupling 33 to axially move away from auxiliary rocker arm 36*a* against the spring bias. As a result, power transmission through auxiliary rocker arm 36*a* to coupling 33 of the exhaust valve side is shutoff. As explained above, each of intake and exhaust valves of each of several engine cylinders to which the active/inactive valve mode switching mechanism 30 is applied can be switched to an inactive valve mode or to a partial cylinder cutoff mode (simply, a cylinder cutoff mode). As regards the engine cylinder, subjected to the cylinder cutoff mode, fuel injection is inhibited in synchronization with the mode shifting operation from active to inactive.

Figure 3A:
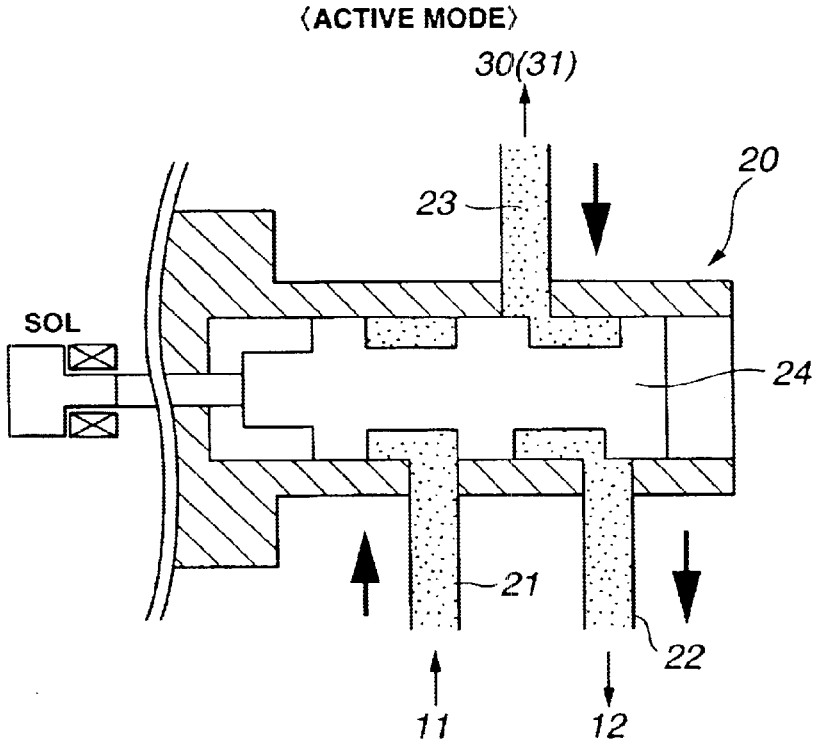
FIGS. 3A and 3B are longitudinal cross-sectional views explaining the operation of a hydraulic pressure control valve for the active/inactive valve mode switching mechanism of FIG. 2.
Figure 3B:
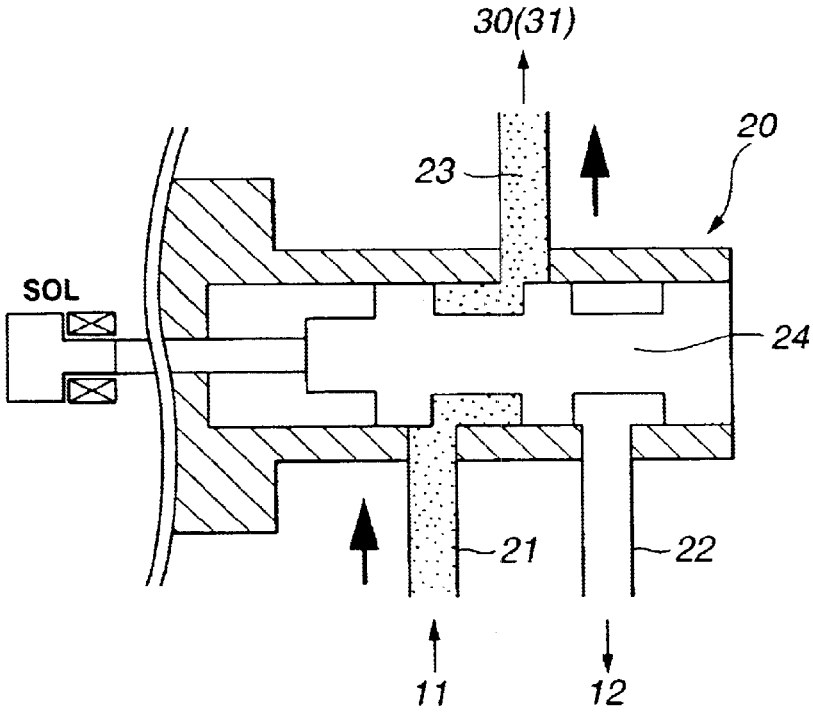

The operation of hydraulic pressure control valve 20 for active/inactive valve mode switching mechanism 30 is hereunder described in detail in reference to FIGS. 3A and 3B. FIG. 3A shows a first spool valve position in which fluid communication between a supply line 21 and a control line 23 connected to hydraulic pressure chamber 31 of active/inactive valve mode switching mechanism 30 is blocked, while fluid communication between control line 23 and a drain line 22 is established. FIG. 3B shows a second spool valve position in which fluid communication between supply line 21 and control line 23 is established, while fluid communication between control line 23 and drain line 22 is blocked. Supply line 21 is fluidly connected to the oil gallery, while drain line 22 is fluidly connected to oil pan 12. On the other hand, control line 23 is fluidly connected to hydraulic pressure chamber 31 of active/inactive valve mode switching mechanism 30. As seen in FIGS. 3A and 3B, control line 23 serves as a portion of a hydraulic pressure supply passage containing at least the supply line 21 as well as a portion of a hydraulic pressure drain passage containing at least the drain line 22. As shown in FIGS. 3A and 3B, hydraulic pressure control valve 20 is comprised of a three-port electromagnetic solenoid valve. By way of solenoid voltage feedback control, the actual opening area of the oil drain passage comprised of control line 23 and drain line 22 is continually steplessly increased or decreased depending on an axial position of a spool valve 24 of hydraulic pressure control valve 20 (see FIG. 3A). In other words, the actual opening area of the oil supply passage comprised of supply line 21 and control line 23 is continually steplessly decreased or increased depending on an axial position of spool valve 24 (see FIG. 3B). Therefore, the supply oil pressure to active/inactive valve mode switching mechanism 30 can be changed to and held at an arbitrary pressure value based on the axial position of spool valve 24. In the shown embodiment, although the axial position of spool 24 is adjusted by way of solenoid voltage feedback control, in lieu thereof the spool position may be adjusted by way of solenoid current feedback control. As discussed above, the opening area of the supply passage and the opening area of the drain passage vary depending on the axial position of valve spool 24. For instance, duty-cycle control is often used as solenoid voltage feedback control. During the all-cylinder working mode, valve spool 24 is kept at the first axial position shown in FIG. 3A, and whereby the supply passage (containing supply line 21) is closed while the opening area of the orifice passage of the drain passage (containing drain line 22) is increased. With the valve spool kept at the first axial position, the working oil in hydraulic pressure chamber 31 is drained via drain line 22 into oil pan 12, and therefore the pressure in hydraulic pressure chamber 31 drops. In contrast, during the cylinder cutoff mode, valve spool 24 is kept at the second axial position shown in FIG. 3B, and whereby the drain passage (containing drain line 22) is closed while the opening area of the orifice passage of the supply passage (containing supply line 21) is increased. With the valve spool kept at the second axial position, the working oil pressurized by oil pump 11 is delivered through supply line 21 into hydraulic pressure chamber 31 of active/inactive valve mode switching mechanism 30, and therefore the pressure in hydraulic pressure chamber 31 rises up to an arbitrary pressure level based on the opening area of the orifice passage, in other words, the axial position of spool 24.

Figure 4:
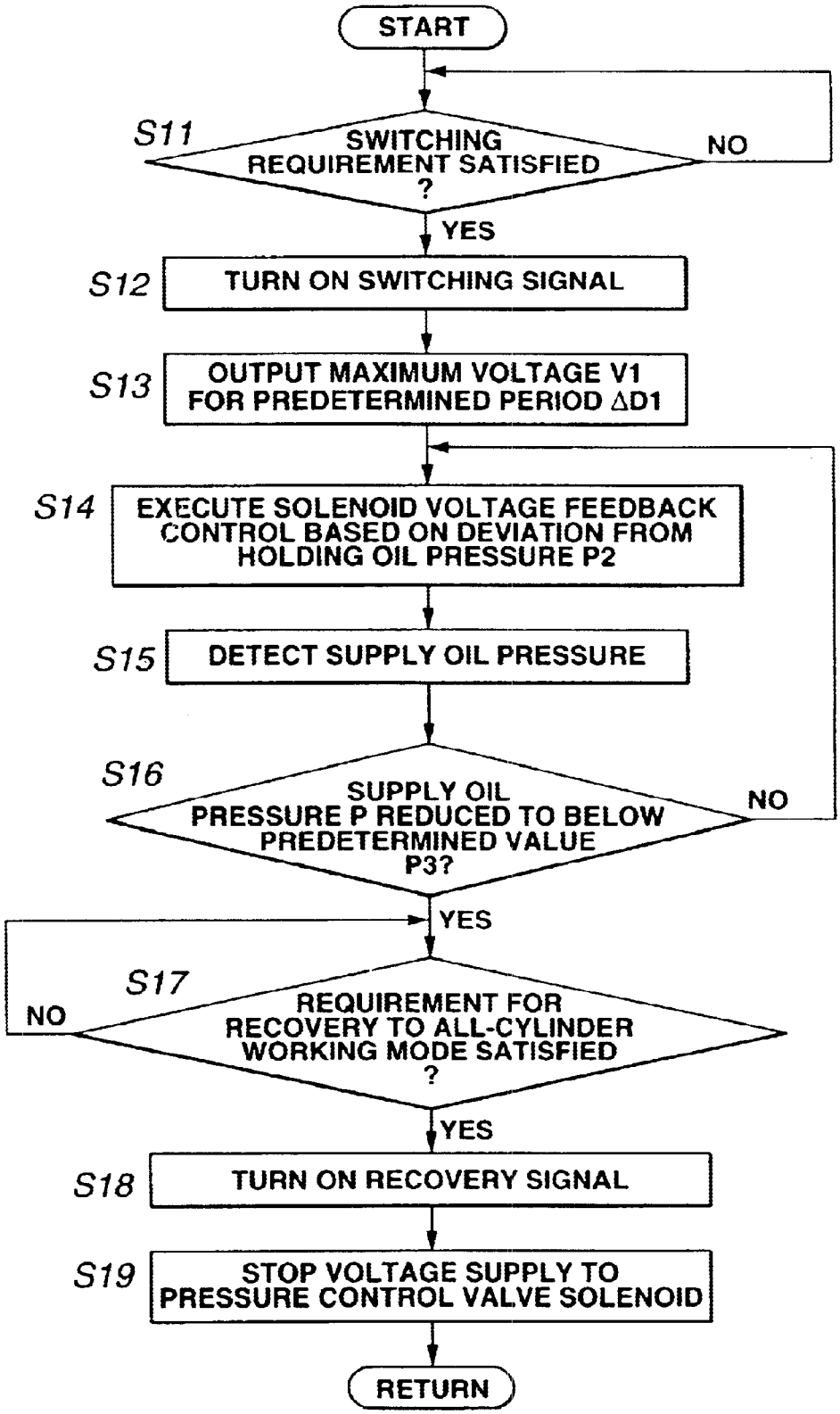
FIG. 4 is a flow chart illustrating a hydraulic pressure control routine executed by the system of the first embodiment.

Referring now to FIG. 4, there is shown the hydraulic pressure control routine executed within the CPU of ECU 14 incorporated in the system of the first embodiment. The control routine of FIG. 4 is executed as time-triggered interrupt routines to be triggered every predetermined time intervals such as 10 msec.

At step S11, a check is made to determine, depending upon engine operating conditions, if a requirement for switching from all-cylinder working mode to cylinder cutoff mode is satisfied or detected. For instance, during a low load condition such as during idling or at light load operation, the previously-noted all-cylinder working mode to cylinder cutoff mode switching requirement is satisfied. That is, when the answer to step S11 is in the affirmative (YES), the routine proceeds from step S11 to step S12. Conversely when the answer to step S11 is in the negative (NO), one cycle of the routine terminates.

Figures 5A, 5B, 5C, 5D:
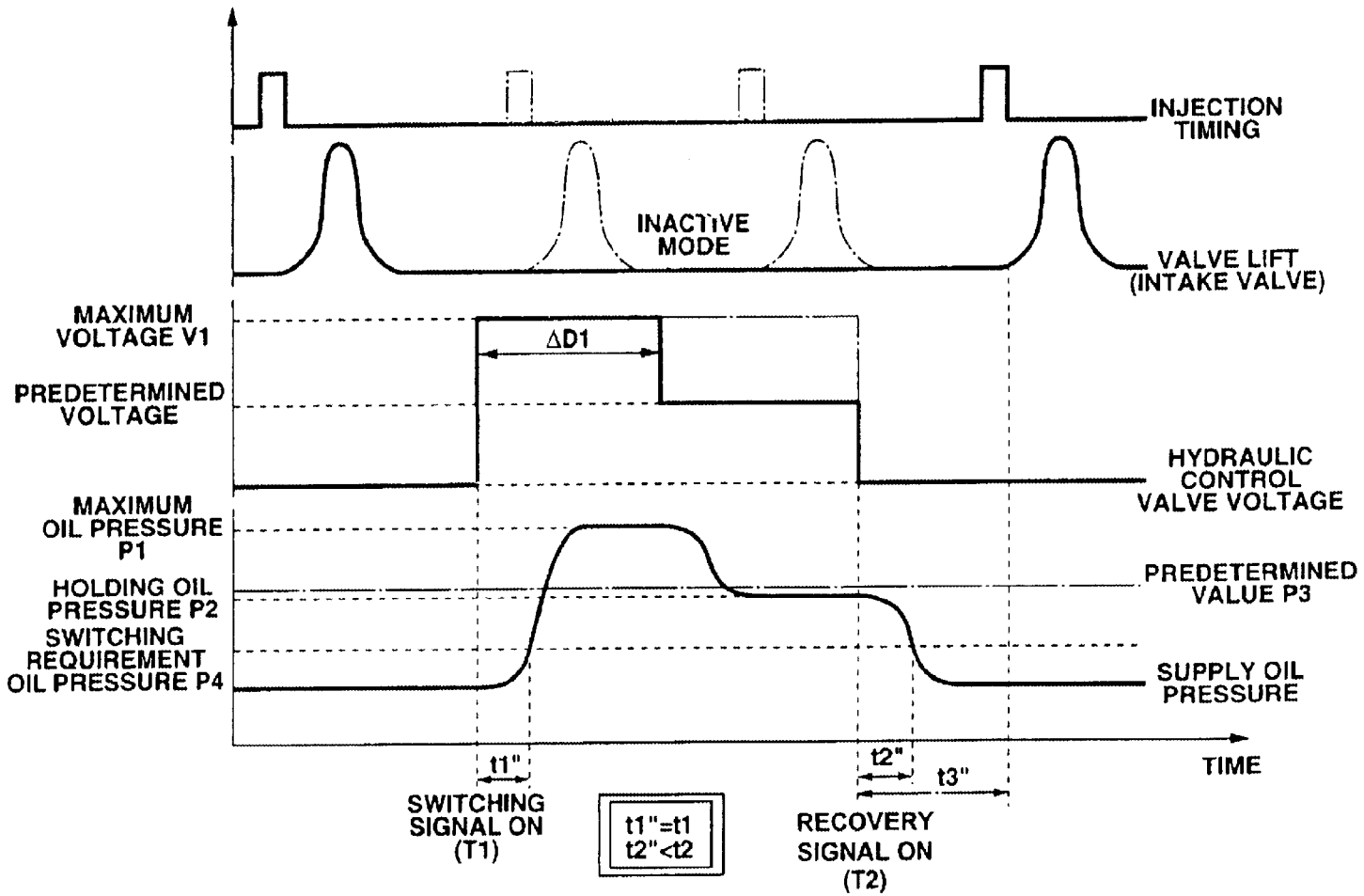
FIGS. 5A–5D are time charts respectively showing variations in the fuel-injection timing, intake valve lift, hydraulic control valve voltage, and supply oil pressure in the system of the first embodiment.

At step S12, an active/inactive valve mode switching signal (simply, a switching signal) is turned ON. Concretely, at step S13 the supply voltage to the solenoid of hydraulic pressure control valve 20 is held at its maximum voltage value V1 for a predetermined time period ΔD1 from a time T1 when the operating mode is switched from all-cylinder working mode to cylinder cutoff mode (see FIG. 5C). By maintaining the supply voltage at the maximum voltage value V1 during predetermined time period ΔD1, spool 24 is shifted toward and kept at the second axial position (the rightmost axial position) shown in FIG. 3B. Thus, the opening area (the degree of opening) of the orifice passage of the supply passage (supply line 21) becomes a maximum value. As a consequence, the supply oil pressure to active/inactive valve mode switching mechanism 30 quickly rises up to a predetermined maximum oil pressure P1 such as 5 kg/cm . As soon as the above-mentioned predetermined time period ΔD1 has expired and thus the supply oil pressure rises adequately (up to the predetermined maximum oil pressure P1 such as 5 $kg/cm^2$), step S14 occurs. At step S14, the hydraulic pressure control valve solenoid voltage feedback control is executed so that the actual supply oil pressure P detected by oil pressure sensor 15 is brought closer to a desired pressure value, that is, a predetermined holding oil pressure P2 such as 1.2 $kg/cm^2$. As a result of this, spool 24 moves somewhat leftwards from the second axial position (the rightmost axial position) of FIG. 3B. Owing to the slight axial displacement of spool 24, the opening area of the orifice passage of the supply passage (supply line 21) becomes reduced to below the maximum opening area. Thereafter, at step S15, the supply oil pressure P is newly detected. Subsequently to step S15, at step S16, a check is made to determine whether the supply oil pressure P detected by oil pressure sensor 15 is less than or equal to a predetermined pressure value P3. Taking full account of fluctuations in the supply oil pressure P occurring during the solenoid voltage feedback control, predetermined pressure value P3 (e.g., 1.5 $kg/cm^2$) is set to a pressure level slightly higher than predetermined holding oil pressure P2 (e.g., 1.2 $kg/cm^2$). The CPU of ECU 14 determines that the supply oil pressure P has been reduced to a pressure level close to predetermined holding oil pressure P2 (e.g., 1.2 $kg/cm^2$), when the condition of step S16 is satisfied, that is, in case of $P<P3$. When the answer to step S16 is affirmative (YES), the routine proceeds from step S16 to step S17. Conversely when the answer to step S16 is negative (NO), the routine returns from step S16 to step S14.

At step S17, a check is made to determine, depending upon the current engine operating conditions, whether a requirement for recovery to all-cylinder working mode is satisfied or detected. When the answer to step S17 is affirmative, the routine proceeds to step S18. In contrast, when the answer to step S17 is negative, step S17 is repeatedly executed.

At step S18, a recovery signal is turned ON, so as to release the cylinder cutoff mode and to recover to the all-cylinder working mode. Concretely, at step S19, the supply voltage to the solenoid of hydraulic pressure control valve 20 is adjusted to a zero voltage level; in other words, the voltage supply to the pressure control valve solenoid is stopped. Owing to the stoppage of voltage supply to the pressure control valve solenoid, spool 24 is moved toward and kept at the first axial position (the spring-loaded position or the leftmost axial position) shown in FIG. 3A. Therefore, the opening area (the degree of opening) of the orifice passage of the drain passage (drain line 22) becomes a maximum value. Hydraulic pressure in hydraulic pressure chamber 31 of active/inactive valve mode switching mechanism 30 quickly falls. As a consequence, opening and closing actions of intake and exhaust valves of all engine cylinders are restarted, and in synchronization therewith fuel injection is restarted.

As discussed above, according to the system of the first embodiment, the hydraulic pressure in hydraulic pressure chamber 31 has already been reduced to a pressure level close to predetermined holding oil pressure P2 (e. g., 1.2 kg/cm$^2$) at the point of time T2 that the inactive mode (cylinder cutoff mode) is released. In other words, the system of the first embodiment operates to temporarily set supply oil pressure P to predetermined maximum pressure P1 for predetermined time period ΔD1 when initiating the inactive mode (cylinder cutoff mode), and thereafter to hold supply oil pressure P at a predetermined release pressure lower than predetermined maximum pressure P1 before the inactive mode is released. Therefore, it is possible to adequately shorten a response time delay t2 in recovery to the active valve mode, that is, a recovery time or a release time t2 needed in order for the supply oil pressure to be dropped down to a switching requirement oil pressure P4 such as 1.0 kg/cm$^2$ above which piston plunger 38 forces the associated couplings 33 to axially move away from auxiliary rocker arm 36*a* against the spring bias and thus power transmission through auxiliary rocker arm 36*a* to couplings 33 of the intake valve side is shut off and the cylinder cutoff mode is attained. The shortened response time delay t2 in recovery to the active valve mode enhances the response to a pressure drop in supply oil pressure in the recovery period to the active valve mode. Thus, there is no possibility that fuel injection restarts before the engine valve subjected to cylinder cutoff control is completely switched or shifted from the inactive mode (cylinder cutoff mode) to the active mode (all-cylinder working mode). This improves the exhaust emission control performance. That is, predetermined holding oil pressure P2 is determined or set to an adequately small pressure value such as 1.2 kg/cm$^2$, so that the intake valve can be certainly activated and opened to match the injection timing of the earliest fuel injection initiated after the cylinder cutoff mode (inactive valve mode) is released. Additionally, to avoid malfunction of active/inactive valve mode switching mechanism 30, predetermined holding oil pressure P2 is set at a pressure value (1.2 kg/cm$^2$) somewhat higher than switching requirement oil pressure P4 (1.0 kg/cm$^2$). In the system of the first embodiment, as can be seen from the flow chart of FIG. 4, during the cylinder cutoff mode, a series of steps S14, S15, and S16 are repeatedly executed until the supply oil pressure drops to a pressure level close to predetermined holding oil pressure P2. In other words, the system of the first embodiment inhibits the closed-loop cylinder cutoff control function from being released or disengaged, until the supply oil pressure drops to a pressure level close to predetermined holding oil pressure P2. This more greatly enhances the response to a supply-oil-pressure drop in the recovery period to the active valve mode. Even in the presence of unstable supply oil pressure (undesired supply pressure fluctuations), which may result in system malfunction, there is no risk of releasing the cylinder cutoff mode. The system of the first embodiment is superior in reliability, because of better setting of the comparative pressure value, that is, predetermined pressure value P3 (1.5 kg/cm$^2$) slightly higher than predetermined holding oil pressure P2 (1.2 kg/cm$^2$).

Furthermore, in the system of the first embodiment, the supply voltage to the solenoid of hydraulic pressure control valve 20 is held at its maximum voltage value V1 for predetermined time period ΔD1 from time T1 when switching to the cylinder cutoff mode occurs and then the cylinder cutoff mode begins, so that the opening area of the orifice passage of the supply passage (supply line 21) becomes maximum during predetermined time period ΔD1. Therefore, it is possible to effectively shorten a response time delay t1 in switching to the inactive valve mode (cylinder cutoff mode), that is, a response time delay t1 from the cylinder-cutoff-mode starting point T1 to the time when the supply oil pressure reaches switching requirement oil pressure P4. That is, the system of the first embodiment is superior in the response to a supply-oil-pressure rise at the early stage of switching to the inactive valve mode (cylinder cutoff mode). As set forth above, the system of the first embodiment has a relatively simple construction instead of using an assist oil pump. However, in the system of the first embodiment using the closed-loop cylinder cutoff control (hydraulic-pressure control valve solenoid voltage feedback control), it is possible to effectively enhance the control responsiveness during the cylinder-cutoff-mode starting period as well as during the cylinder-cutoff-mode releasing period.

Referring now to FIGS. 10A–10D, there is shown the comparative example that the supply voltage to the solenoid of hydraulic pressure control valve 20 is held at its maximum voltage value V1 for a time period (T2-T1) from the cylinder-cutoff-mode starting point T1 to the cylinder-cutoff-mode releasing point T2. As can be appreciated from comparison between the supply oil pressure characteristics obtained by the closed-loop cylinder cutoff control (hydraulic-pressure control valve solenoid voltage feedback control) of the system of the first embodiment (see FIGS. 5C and 5D) and the supply oil pressure characteristics obtained by hydraulic-pressure control valve solenoid voltage control of the system of the comparative example (see FIGS. 10C and 10D), the response time delay t1 in switching the inactive mode obtained by the comparative example is essentially identical to the response time delay t1 obtained by the first embodiment. On the other hand, there is an increased tendency for the recovery time t2 obtained by the comparative example to be longer than the recovery time t2 obtained by the first embodiment (that is, t2<t2). Due to the comparatively longer recovery time t2, there is a possibility that this recovery time t2 becomes longer than a time t3 required to determine if fuel injection is enabled or disabled and thus fuel injection restarts before initiation of the all-cylinder working mode. This deteriorates the exhaust emission control performance and lowers fuel economy. In contrast to the above, in the system of the first embodiment, the recovery time t2 can be shortened adequately and thus there is a less possibility that the recovery time t2 is longer than a time t3 required to determine if fuel injection is enabled or disabled.

Figure 6:
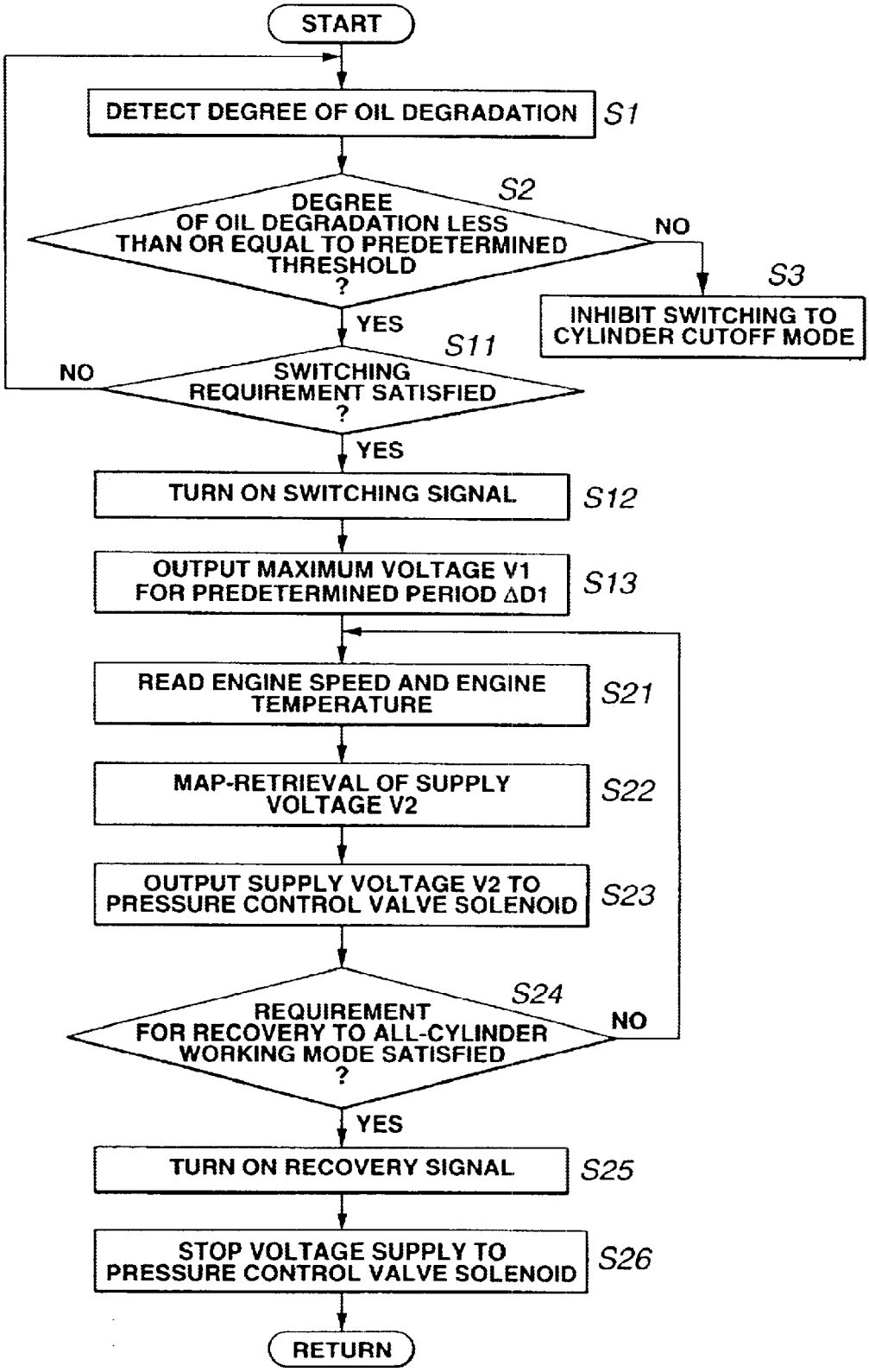
FIG. 6 is a flow chart illustrating a hydraulic pressure control routine executed by the system of the second embodiment.
Figures 7A, 7B, 7C, 7D:
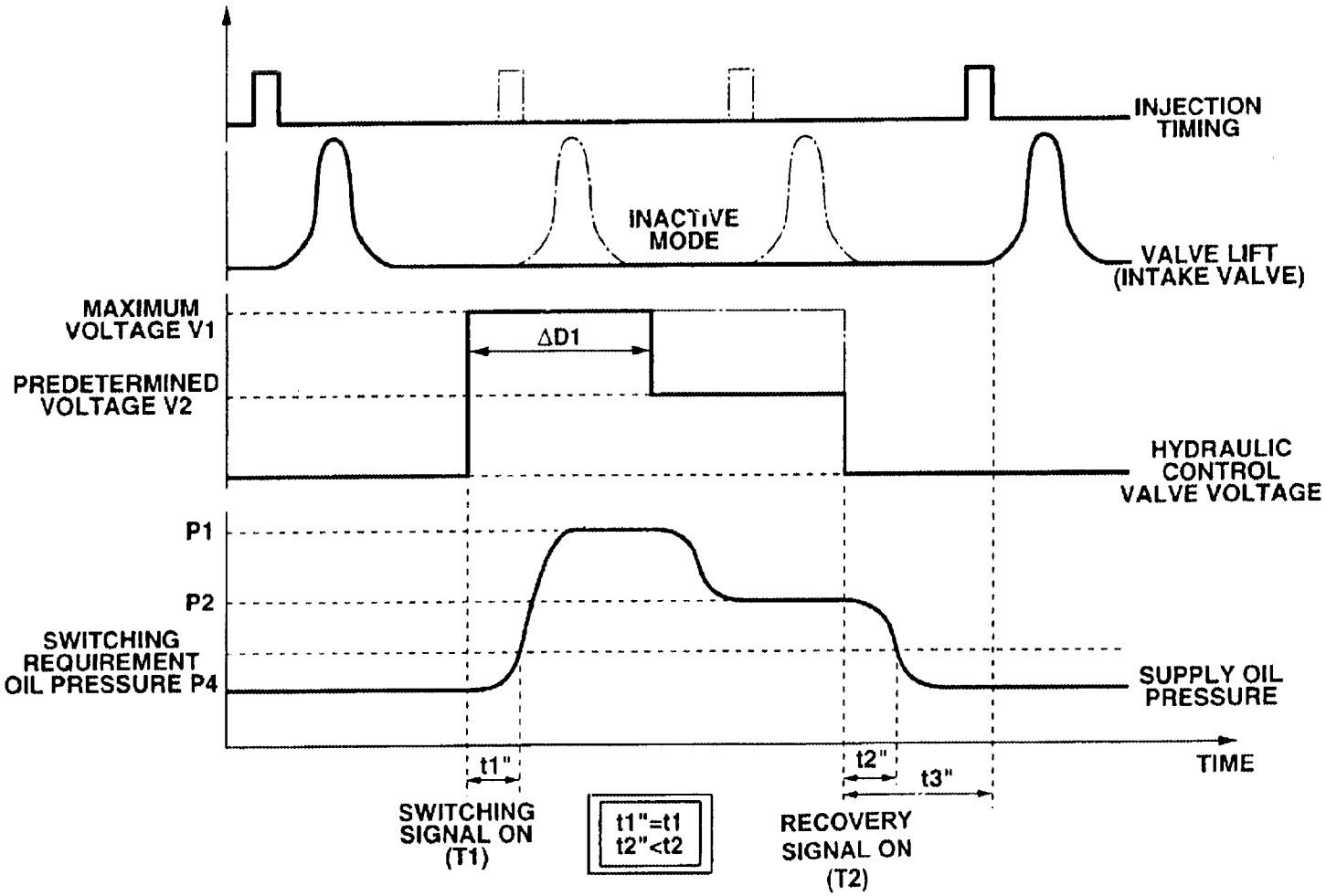
FIGS. 7A–7D are time charts respectively showing variations in the fuel-injection timing, intake valve lift, hydraulic control valve voltage, and supply oil pressure in the system of the second embodiment.

Referring now to FIG. 6, there is shown the hydraulic pressure control routine executed within the CPU of ECU 14 incorporated in the system of the second embodiment. The control routine of FIG. 6 is also executed as time-triggered interrupt routines to be triggered every predetermined time intervals. Briefly speaking, the routine or arithmetic processing of the system of the second embodiment shown in FIG. 6 is somewhat different from that of the first embodiment, in that a series of steps S1, S2, and S3 that inhibit shifting to the cylinder cutoff mode depending on the degree of degradation of oil are further added, and a closed-loop control system constructed by at least steps S14, S15, and S16 of FIG. 4 is replaced with an open-loop control system constructed by at least steps S21, S22, and S23 of FIG. 6. Thus, the same step numbers used to designate steps in the routine shown in FIG. 4 will be applied to the corresponding step numbers used in the routine shown in FIG. 6, for the purpose of comparison of the two different interrupt routines. Steps S1–S3, and S21–S26 will be hereinafter described in detail with reference to the accompanying drawings, while detailed description of steps S11 through S13 will be omitted because the above description thereon seems to be self-explanatory.

At step S1, a check is made to determine whether the degree of degradation of engine oil (or the degree of deterioration of working fluid) detected by oil degradation sensor 18 is read.

At step S2, a check is made to determine whether the degree of degradation of oil is less than or equal to a predetermined threshold value. When the answer to step S2 is in the negative (NO), that is, the degree of degradation of oil exceeds the predetermined degree of degradation, the routine proceeds from step S2 to step S3. At step S3, switching to the cylinder cutoff mode (inactive valve mode) is inhibited. Conversely when the answer to step S2 is in the affirmative (YES), that is, the working oil is not so degraded, the routine flows from step S2 to step S11. Under a particular engine operating condition, for example, during idling or during part load condition, when the previously-noted all-cylinder working mode to cylinder cutoff mode switching requirement is satisfied, the routine proceeds from step S11 to step S12. The active/inactive valve mode switching signal is turned ON through step S12, and thereafter the supply voltage to the solenoid of hydraulic pressure control valve 20 is kept at its maximum voltage value V1 for a predetermined time period ΔD1 from the cylinder-cutoff-mode starting point T1. As soon as the predetermined time period ADI has expired, step S21 occurs.

At step S21, the engine speed detected by engine speed sensor 16 and the engine temperature detected by engine temperature sensor 17 are read. The engine speed data and engine temperature data are used as system inputs.

Figure 8:
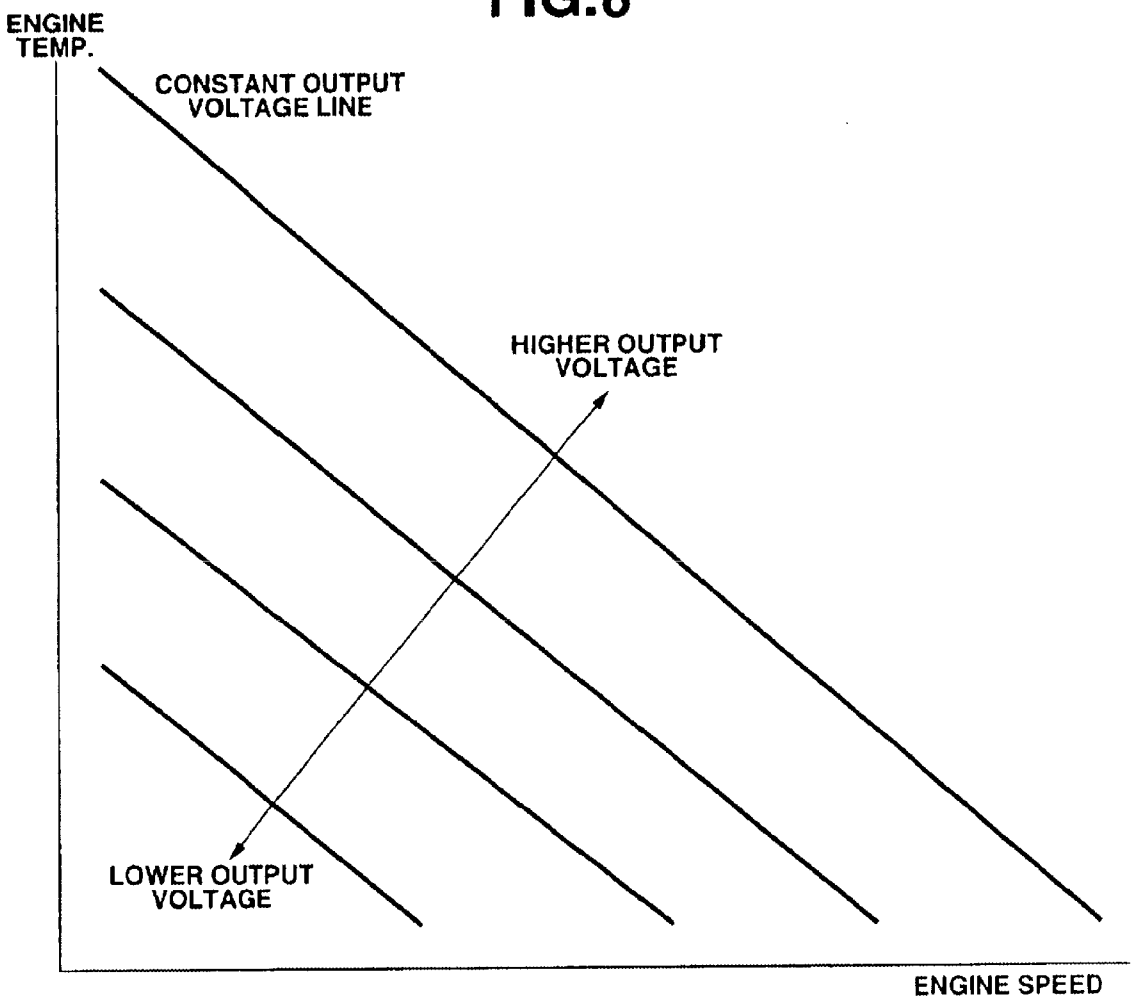
FIG. 8 is a preprogrammed engine conditions (engine speed and engine temperature) versus solenoid output voltage characteristic map.

At step S22, a predetermined supply voltage V2 to be applied to the solenoid of hydraulic pressure control valve 20 is calculated or map-retrieved from a preprogrammed engine operating conditions (that is, engine speed and engine temperature) versus solenoid output voltage characteristic map shown in FIG. 8, so that the supply oil pressure (system output) in hydraulic pressure chamber 31 of active/inactive valve mode switching mechanism 30 is controlled or regulated to a predetermined holding oil pressure P2 by way of open-loop control for supply oil pressure P. At step S23, the supply voltage V2 calculated through steps S21 and S22 is output to the solenoid of hydraulic pressure control valve 20. After step S23, a series of steps S24–S26 are executed. Steps S24–S26 are similar to steps S17–S19 of FIG. 4.

At step S24, a test is made to determine, depending upon the current engine operating conditions, whether the requirement for recovery to all-cylinder working mode is satisfied. When the answer to step S24 is negative (NO), the routine returns from step S24 to step S21. Conversely when the answer to step S24 is affirmative (YES), the routine advances from step S24 to step S25. At step S25, a recovery signal is turned ON to release the cylinder cutoff mode and to initiate the all-cylinder working mode. At step S26, the supply voltage to the solenoid of hydraulic pressure control valve 20 is adjusted to a zero voltage level so as to stop the voltage supply to the pressure control valve solenoid. Due to the stoppage of voltage supply to the pressure control valve solenoid, the supply oil pressure can drop rapidly. As a consequence, opening and closing actions of intake and exhaust valves of all engine cylinders are restarted, and in synchronization therewith fuel injection is restarted.

As already explained, in the system of the first embodiment based on closed-loop solenoid voltage control in which the oil pressure sensor signal is used, the actual supply oil pressure P detected by oil pressure sensor 15 can be brought closer to a desired pressure value (predetermined holding oil pressure P2) with a high control accuracy. On the other hand, in the system of the second embodiment based on open-loop solenoid voltage control in which the oil pressure sensor signal is ignored, the actual supply oil pressure cannot be brought closer to predetermined holding oil pressure P2 with a higher control accuracy than the system of the first embodiment. However, the system of the second embodiment can eliminate oil pressure sensor 15. Although the system of the second embodiment is very simple in construction, it is possible to satisfactorily enhance both the response to a supply-oil-pressure rise at the early stage of switching to the inactive mode (cylinder cutoff mode) and the response to a supply-oil-pressure drop in the recovery period to the active mode (all-cylinder working mode). Furthermore, in the system of the second embodiment, the supply voltage to the solenoid of hydraulic pressure control valve 20 is optimized or rationalized based on both the current engine speed and the current engine temperature (see steps S21 and S22), thereby enhancing the control accuracy for the supply oil pressure regulated by hydraulic pressure control valve 20. Additionally, steps S1–S3 are added so as to inhibit shifting to the cylinder cutoff mode depending upon whether the threshold for the degree of degradation of engine oil is reached. Steps S1–S3 function to certainly inhibit switching to the cylinder cutoff mode when the degree of degradation of working oil is high and thus there is an increased tendency for system malfunction to occur. This enhances control system reliability.

In the system of the second embodiment of FIG. 6, to enhance the control accuracy and to avoid system malfunction, the control system uses the oil degradation sensor signal. In order to provide a simpler control system (a first modified arithmetic processing), a series of steps S1–S3 may be omitted and oil degradation sensor 18 may be omitted. Alternatively, in order to prevent system malfunction occurring due to degraded oil and to provide a control system (a second modified arithmetic processing) having a more enhanced system reliability, a series of steps S1–S3 may be added just before step S11 of the control routine of the first embodiment of FIG. 4. As discussed above, the system of the first embodiment uses the oil pressure sensor signal for closed-loop solenoid voltage control (solenoid voltage feedback control) that brings the actual supply oil pressure P (the oil pressure sensor signal value) closer to a desired pressure value (predetermined holding oil pressure P2) with a high control accuracy. Instead of directly using the oil pressure sensor signal, an estimated supply oil pressure may be used. That is to say, in order to enhance the control accuracy without using the oil pressure sensor signal, and to provide a simplified control system (a third modified arithmetic processing), the supply oil pressure to be fed from hydraulic pressure control valve 20 to active/inactive valve mode switching mechanism 30 may be estimated based on an engine-speed indicative signal from engine speed sensor 16 and an engine-temperature indicative signal from engine temperature sensor 17. In the third modified arithmetic processing, hydraulic pressure control valve solenoid voltage feedback control is executed so that the estimated supply oil pressure (based on engine speed and engine temperature) is brought closer to a desired pressure value, that is, a predetermined holding oil pressure P2 such as 1.2 kg/cm$^2$.

Figures 9A, 9B, 9C, 9D:
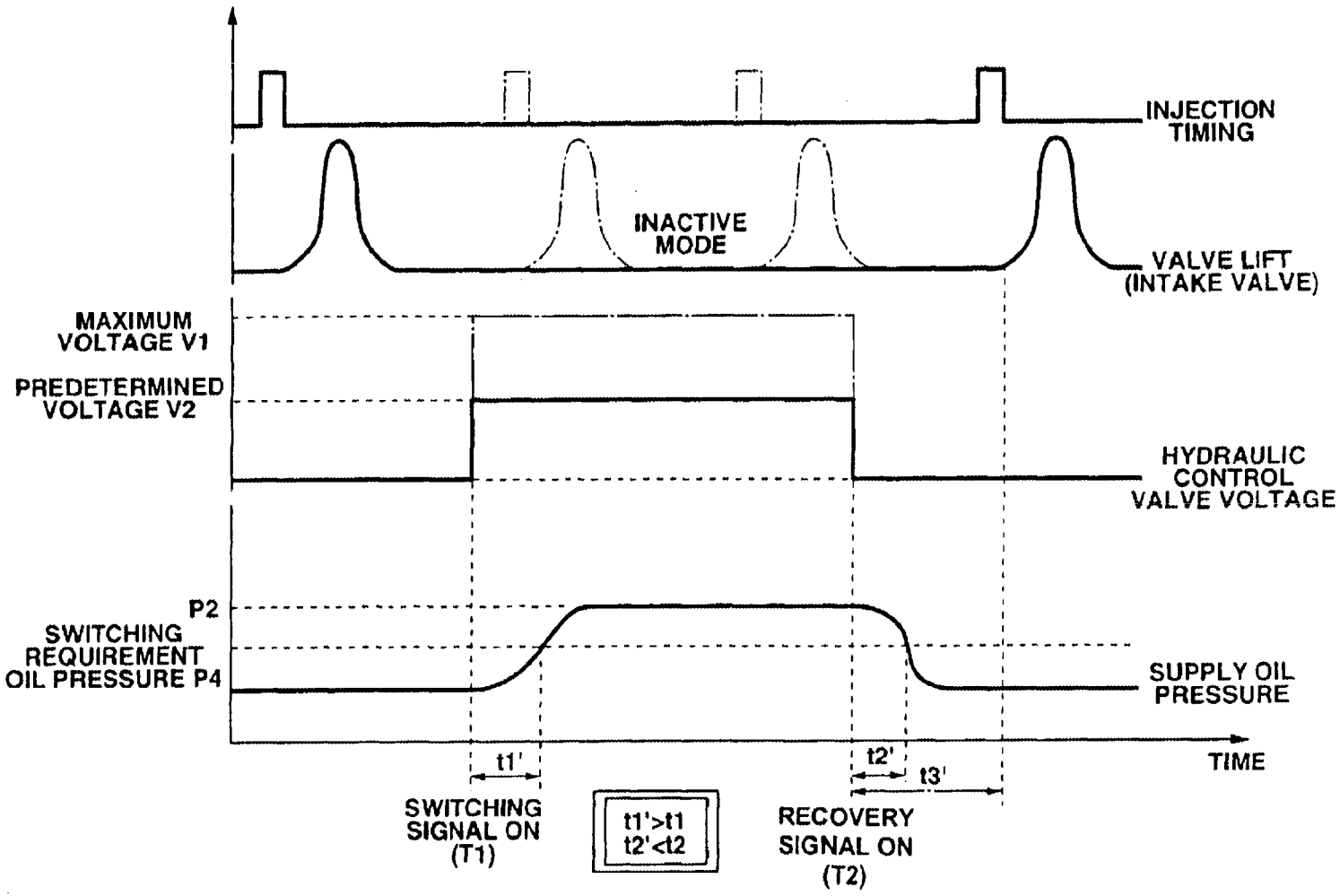
FIGS. 9A–9D are time charts respectively showing variations in the fuel-injection timing, intake valve lift, hydraulic control valve voltage, and supply oil pressure in the modified system of the second embodiment.
Figures 10A, 10B, 10C, 10D:
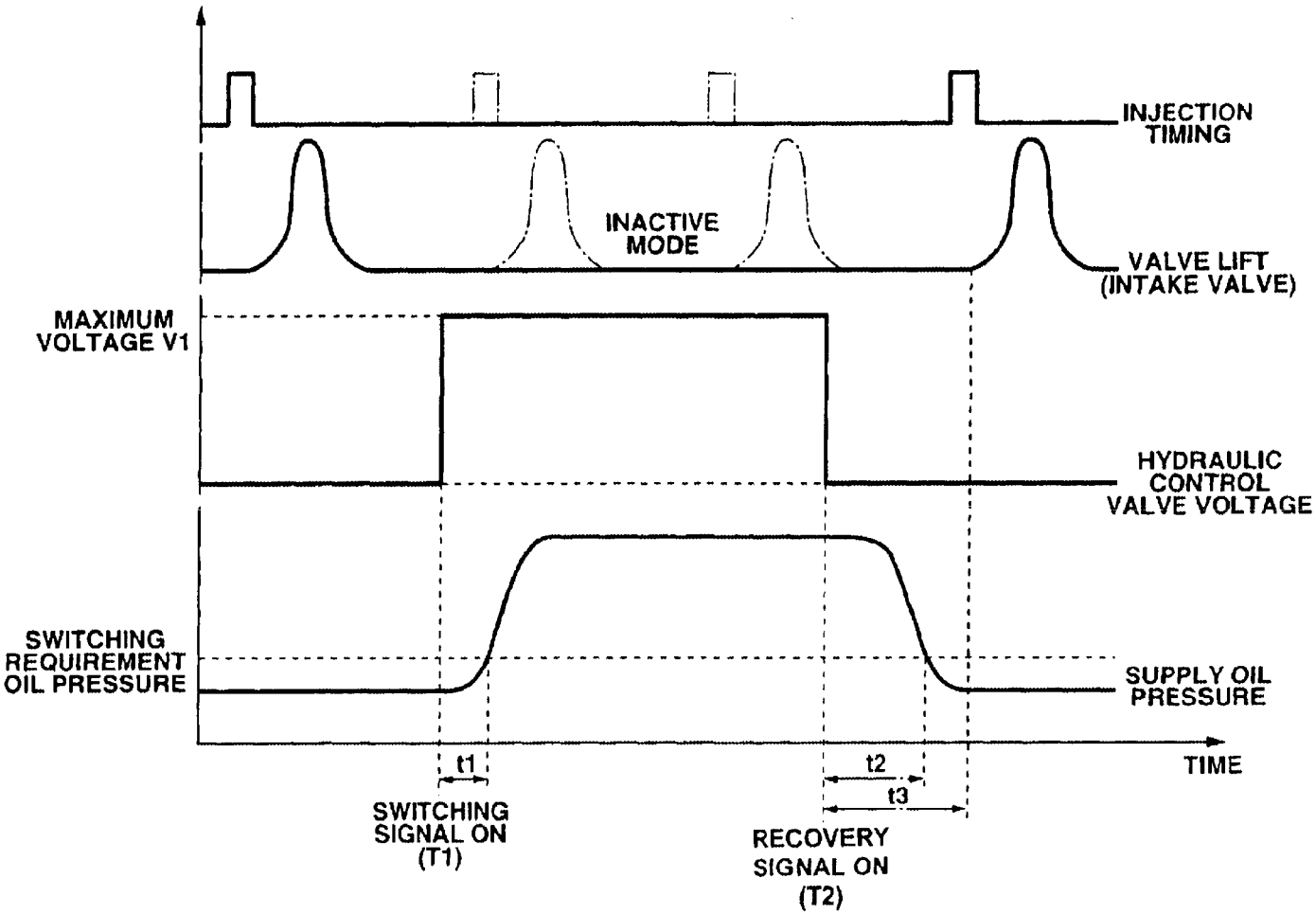
FIGS. 10A–10D are time charts showing control characteristics obtained by a comparative example in which an output voltage signal to an electromagnetic solenoid of the hydraulic pressure control valve is held at its maximum voltage level V1 during a time period (T2-T1) from a time T1 when the operating mode is switched to the inactive valve mode (cylinder cutoff mode) to a time T2 when the inactive valve mode is released.

As a fourth modified arithmetic processing, step S13 may be omitted from the control routine of FIG. 6, thereby simplifying the control system. In more detail, steps S1–S3, S11–S12, and S21–S26 construct the fourth modified arithmetic processing. Thus, as soon as the active/inactive valve mode switching signal is turned ON through step S12, the routine advances from step S12 to a series of steps S21–S26, such that the supply voltage to the pressure control valve solenoid is controlled or adjusted to a predetermined supply voltage level V2 (see FIG. 9C) so as to bring the supply oil pressure closer to a desired pressure value, that is, a predetermined holding oil pressure P2 such as 1.2 kg/cm$^2$ (see FIGS. 9A–9D). Owing to the supply voltage control, the supply oil pressure varies as shown in FIG. 9D. In this case, during a time period (T2-T1) from cylinder-cutoff-mode starting point T1 to cylinder-cutoff-mode releasing point T2, the supply voltage to the pressure control valve solenoid is kept at or limited to predetermined supply voltage level V2. Therefore, as seen in FIG. 9D, the response time delay t1 in switching to the inactive valve mode (cylinder cutoff mode), that is, a response time delay t1 from cylinder-cutoff-mode starting point T1 to the time when the supply oil pressure reaches switching requirement oil pressure P4, tends to be slightly longer than the response time delay t1 in switching the inactive mode obtained by the comparative example of FIGS. 10A–10D (that is, t1'>t1). In other words, the fourth modified arithmetic processing is somewhat inferior in the control responsiveness at the early stage of switching to the cylinder cutoff mode. This is because the system based on the fourth modified arithmetic processing operates to hold supply oil pressure P at a predetermined release pressure lower than predetermined maximum pressure P1 before the inactive mode is released, without temporarily setting supply oil pressure P at predetermined maximum pressure P1 for predetermined time period ΔD1 when initiating the inactive mode. On the other hand, there is an increased tendency for the recovery time t2 obtained by the fourth modified arithmetic processing related to FIGS. 9A–9D to be shorter than the recovery time t2 obtained by the comparative example related to FIGS. 10A–10D (that is, t2'<t2). That is, the fourth modified arithmetic processing is superior in the control responsiveness in the recovery period to the all-cylinder working mode. Additionally, the fourth modified arithmetic processing is simpler than the system of the second embodiment.

The entire contents of Japanese Patent Application No. P2001-21308 (filed Jan. 30, 2001) is incorporated herein by reference.

While the foregoing is a description of the preferred embodiments carried out the invention, it will be understood that the invention is not limited to the particular embodiments shown and described herein, but that various changes and modifications may be made without departing from the scope or spirit of this invention as defined by the following claims.

What is claimed is:

1. A hydraulic pressure control system for a cylinder cutoff device of an internal combustion engine, the cylinder cutoff device through which a first group of engine cylinders are cut off with at least intake valves of engine valves included in the first group kept inactive, while a second group of engine cylinders are working, the hydraulic pressure control system comprising:

a valve mode switching mechanism operated responsively to supply oil pressure and capable of switching an operating mode of at least an intake valve of engine valves of each of the first group of engine cylinders from an active mode to an inactive mode;

a hydraulic circuit having a supply passage through which the valve mode switching mechanism is connected to a hydraulic pressure source and a drain passage through which hydraulic pressure in the valve mode switching mechanism is relieved;

a hydraulic pressure control valve that regulates the supply oil pressure by changing an opening area of the supply passage and an opening area of the drain passage; and a control unit setting the supply oil pressure to a predetermined maximum pressure when initiating the inactive mode by the valve mode switching mechanism, and holding the supply oil pressure at a predetermined oil pressure lower than the predetermined maximum pressure before the inactive mode is released.

2. The hydraulic pressure control system as claimed in claim 1, wherein the control unit controls the supply oil pressure so that the predetermined oil pressure becomes lower than or equal to a predetermined pressure closer to and higher than a predetermined holding oil pressure.

3. The hydraulic pressure control system as claimed in claim 1, wherein the control unit controls the supply oil pressure so that the predetermined oil pressure is brought closer to a predetermined holding oil pressure.

4. The hydraulic pressure control system as claimed in claim 1, wherein the opening area of the supply passage is changed to a maximum value by the hydraulic pressure control valve when initiating the inactive mode by the valve mode switching mechanism.

5. The hydraulic pressure control system as claimed in claim 3, wherein during the inactive mode, the control unit inhibits the inactive mode from being released until the supply oil pressure reaches the predetermined holding oil pressure.

6. The hydraulic pressure control system as claimed in claim 1, which further comprises:

an oil pressure sensor that detects the supply oil pressure fed from the hydraulic pressure control valve to the valve mode switching mechanism; and wherein:

the control unit feedback-controls the supply oil pressure in response to a signal from the oil pressure sensor.

7. The hydraulic pressure control system as claimed in claim 1, which further comprises:

an engine speed sensor that detects engine speed;

an engine temperature sensor that detects engine temperature; and wherein:

the control unit controls the hydraulic pressure control valve in response to a signal from the engine speed sensor and a signal from the engine temperature sensor.

8. The hydraulic pressure control system as claimed in claim 1, which further comprises:

an oil degradation sensor that detects a degree of degradation of oil; and wherein:

the control unit inhibits the operating mode from being switched from the active mode to the inactive mode when the degree of degradation of oil exceeds a predetermined threshold value.

9. The hydraulic pressure control system as claimed in claim 1, wherein:

the predetermined oil pressure is set so that the intake valve of the engine valves of each of the first group of engine cylinders is opened to match an injection timing of the earliest fuel injection initiated after-the inactive mode is released.

10. A hydraulic pressure control system for a cylinder cutoff device of an internal combustion engine, the cylinder cutoff device through which a first group of engine cylinders are cut off with at least intake valves of engine valves included in the first group kept inactive, while a second group of engine cylinders are working, the hydraulic pressure control system comprising:

a valve mode switching mechanism operated responsively to supply oil pressure and capable of switching an operating mode of at least an intake valve of engine valves of each of the first group of engine cylinders from an active mode to an inactive mode;

a hydraulic circuit having a supply passage through which the valve mode switching mechanism is connected to a hydraulic pressure source and a drain passage through which hydraulic pressure in the valve mode switching mechanism is relieved;

a hydraulic pressure control valve that regulates the supply oil pressure by changing an opening area of the supply passage and an opening area of the drain passage; and a control unit holding the supply oil pressure at a predetermined oil pressure lower than a predetermined maximum pressure before the inactive mode is released by the valve mode switching mechanism.

11. The hydraulic pressure control system as claimed in claim 10, wherein:

the supply oil pressure fed to the valve mode switching mechanism when initiating the inactive mode and the predetermined oil pressure held before the inactive mode is released by the valve mode switching mechanism are identical to each other and set to a predetermined holding oil pressure.

12. A hydraulic pressure control system for a cylinder cutoff device of an internal combustion engine, the cylinder cutoff device through which a first group of engine cylinders are cut off with at least intake valves of engine valves included in the first group kept inactive, while a second group of engine cylinders are working, the hydraulic pressure control system comprising:

valve mode switching means operated responsively to supply oil pressure for switching an operating mode of at least an intake valve of engine valves of each of the first group of engine cylinders from an active mode to an inactive mode;

a hydraulic circuit having a supply passage through which the valve mode switching means is connected to a hydraulic pressure source and a drain passage through which hydraulic pressure in the valve mode switching means is relieved;

hydraulic pressure control valve means for regulating the supply oil pressure by changing an opening area of the supply passage and an opening area of the drain passage; and control means for setting the supply oil pressure to a predetermined maximum pressure when initiating the inactive mode by the valve mode switching means, and for holding the supply oil pressure at a predetermined oil pressure lower than the predetermined maximum pressure before the inactive mode is released.

13. A method for controlling supply oil pressure fed to a cylinder cutoff device of an internal combustion engine, the cylinder cutoff device through which a first group of engine cylinders are cut off with at least intake valves of engine valves included in the first group kept inactive, while a second group of engine cylinders are working, the cylinder cutoff device equipped with a valve mode switching mechanism operated responsively to the supply oil pressure and capable of switching an operating mode of at least an intake valve of engine valves of each of the first group of engine cylinders from an active mode to an inactive mode and a hydraulic pressure control valve regulating the supply oil pressure; the method comprising:

determining, depending on engine operating conditions, whether a requirement for switching from the active mode to the inactive mode is satisfied;

setting the supply oil pressure to a predetermined maximum pressure for a predetermined time period when the requirement for switching from the active mode to the inactive mode is satisfied;

detecting the supply oil pressure fed from the hydraulic pressure control valve to the valve mode switching mechanism; and feedback-controlling the supply oil pressure so that the supply oil pressure is brought closer to a predetermined holding oil pressure less than the predetermined maximum pressure before the inactive mode is released.

14. A method for controlling supply oil pressure fed to a cylinder cutoff device of an internal combustion engine, the cylinder cutoff device through which a first group of engine cylinders are cut off with at least intake valves of engine valves included in the first group kept inactive, while a second group of engine cylinders are working, the cylinder cutoff device equipped with a valve mode switching mechanism operated responsively to the supply oil pressure and capable of switching an operating mode of at least an intake valve of engine valves of each of the first group of engine cylinders from an active mode to an inactive mode and a hydraulic pressure control valve regulating the supply oil pressure; the method comprising:

determining, depending on engine operating conditions, whether a requirement for switching from the active mode to the inactive mode is satisfied;

setting the supply oil pressure to a predetermined maximum pressure for a predetermined time period when the requirement for switching from the active mode to the inactive mode is satisfied;

detecting engine speed and engine temperature as system inputs; and controlling the supply oil pressure by the system inputs so that the supply oil pressure is regulated to a predetermined holding oil pressure before the inactive mode is released.

15. A method for controlling supply oil pressure fed to a cylinder cutoff device of an internal combustion engine, the cylinder cutoff device through which a first group of engine cylinders are cut off with at least intake valves of engine valves included in the first group kept inactive, while a second group of engine cylinders are working, the cylinder cutoff device equipped with a valve mode switching mechanism operated responsively to the supply oil pressure and capable of switching an operating mode of at least an intake valve of engine valves of each of the first group of engine cylinders from an active mode to an inactive mode, a hydraulic circuit having a supply passage through which the valve mode switching mechanism is connected to a hydraulic switching device is relieved, and a hydraulic pressure control valve regulating the supply oil pressure by changing an opening area of the supply passage and an opening area of the drain passage; the method comprising:

determining, depending on engine operating conditions, whether a requirement for switching from the active mode to the inactive mode is satisfied;

detecting engine speed and engine temperature as system inputs; and controlling the supply oil pressure by the system inputs so that the supply oil pressure is held at a predetermined holding oil pressure lower than a predetermined maximum pressure before the inactive mode is released.

16. The method as claimed in claim 15, wherein the supply oil pressure fed to the valve mode switching mechanism when initiating the inactive mode and the predetermined oil pressure held before the inactive mode is released by the valve mode switching mechanism are identical to each other and set to the predetermined holding oil pressure.

* * * * *